US007876349B2

(12) United States Patent
Sato et al.

(10) Patent No.: US 7,876,349 B2
(45) Date of Patent: Jan. 25, 2011

(54) IMAGE FORMING APPARATUS FOR FORMING AN IMAGE IN AN ACCURATE POSITION

(75) Inventors: Koichi Sato, Kanagawa (JP); Naohito Otsuki, Kanagawa (JP); Hirofumi Katayama, Kanagawa (JP); Toshikazu Takubo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 102 days.

(21) Appl. No.: 12/318,997

(22) Filed: Jan. 14, 2009

(65) Prior Publication Data

US 2009/0136277 A1 May 28, 2009

Related U.S. Application Data

(62) Division of application No. 11/217,671, filed on Sep. 2, 2005, now Pat. No. 7,502,047.

(30) Foreign Application Priority Data

Sep. 7, 2004 (JP) ..... P2004-259575

(51) Int. Cl.
*B41J 2/435* (2006.01)

(52) U.S. Cl. ..... 347/262; 347/264

(58) Field of Classification Search ..... 347/227, 347/262, 264, 153, 164; 271/3.06, 3.15–3.18, 271/256–259, 264–266

See application file for complete search history.

(56) References Cited

U.S. PATENT DOCUMENTS

| | | | | |
|---|---|---|---|---|
| 5,197,726 | A | 3/1993 | Nogami | |
| 6,733,009 | B2 * | 5/2004 | Ogasawara | 271/265.01 |
| 7,641,329 | B2 * | 1/2010 | Akiyama et al. | 347/104 |
| 2005/0167904 | A1 | 8/2005 | Yamazaki | |

FOREIGN PATENT DOCUMENTS

| | | |
|---|---|---|
| JP | 60-006535 | 1/1985 |
| JP | 2003-76081 | 3/2003 |
| JP | 2003-122223 | 4/2003 |
| JP | 2003-226448 | 8/2003 |

* cited by examiner

*Primary Examiner*—Hai C Pham
(74) *Attorney, Agent, or Firm*—Morgan, Lewis & Bockius LLP

(57) ABSTRACT

An image forming apparatus includes: a sheet tray; an image forming unit that forms an image on a recording sheet; a sheet transporting path that allows a transportation of the recording sheet fed from the sheet tray to the image forming unit; and a sheet detecting unit that detects a passage of a rear end, with respect to a direction in which the recording sheet is transported, of the recording sheet along the sheet transporting path. The transportation of the recording sheet is temporarily stopped at the time of, or after a predetermined time from when the rear end is detected by the sheet detecting unit. The transportation of the recording sheet is resumed on the basis of data on a size of the transported recording sheet and a timing of image formation by the image forming unit.

1 Claim, 4 Drawing Sheets

IMAGE FORMING APPARATUS FOR FORMING AN IMAGE IN AN ACCURATE POSITION

This application is a divisional of U.S. patent application Ser. No. 11/217,671, filed Sep. 2, 2005, now U.S. Pat. No. 7,502,047 which claims the benefit of Japanese Patent Application No. P2004-259575, filed in Japan on Sep. 7, 2004, both of which are hereby incorporated by reference.

BACKGROUND OF THE INVENTION

1. Field of the Invention

This invention relates to an image forming apparatus adapted to form an image on recording sheets sent to a predetermined position in order from a sheet tray, and more particularly to an image forming apparatus capable of forming an image in an accurate position on each of the recording sheet even when a tab and the like is provided at a front end of the recording sheet sent to the mentioned position.

2. Background Art

In an image forming apparatus adapted to form an image on a recording sheet, especially, in an image forming apparatus adapted to form a visible image on a recording sheet by selectively depositing a powdered toner on a latent image formed owing to an electrostatic potential difference, a means for regulating the recording sheet sending time so as to form an image in an accurate position on the recording sheet is employed. In an electrophotographic image forming apparatus adapted to form an image by using a toner image, and, in an electrostatic recording type image forming apparatus, a toner image is formed on an image carrier, and then sent forward by the movement of a circumferential surface of the image carrier. This toner image is then transferred onto a recording sheet directly or via an intermediate transfer member. During this time, the time at which the recording sheet is sent forward is regulated with respect to the movement of the member on which the toner image is supported, and the recording sheet is brought into contact with an accurate portion of the member on which the toner image is supported. This time regulation is conducted generally by using resist rolls which will be described below.

As shown in FIG. 4, on the upstream side of a transfer unit 101 in which the toner image is transferred onto the recording sheet, two resist rolls 102 arranged in parallel with each other and engaged each other under pressure are provided. When a recording sheet P is sent from a sheet tray 103, a front end of the recording sheet is made to impinge upon pressure engaged portions of the two resist rolls 102 stopped in advance. During this time, after the front end of the recording sheet contacts the resist rolls 102, further upstream side sending rolls 104 feed out the recording sheet P by a predetermined length, and stop with a rear portion of the recording sheet P gripped. As a result, flexure occurs between the sending roll 104 and resist rolls 102 as shown in FIG. 4, and the front end of the recording sheet is pressed against the resist rolls 102 by an elasticity restoration force of the recording sheet itself. Even though the recording sheet is sent in an inclined state during this time, the recording sheet P has a marginal length between the sending rolls 104 and resist rolls 102, so that the front end of the recording sheet P is pressed against the resist rolls 102 with the recording sheet extending at right angles to the axes of the resist rolls.

The driving of the resist rolls 102 is then started in accordance with the time at which the toner image is sent thereto, to send the recording sheet P forward. During this time, the front end of the recording sheet is held between the two resist rolls 102 at right angles to the axes thereof, i.e., the recording sheet is fed forward with a diagonal posture thereof corrected.

The recording sheet is brought into contact with an accurate portion of the toner image being sent thereto, and the toner image is transferred onto the recording sheet.

However, the recording sheets used have been diversified in recent years, and a recording sheet the front end of which does not extend straight at right angles to the direction in which the front end is sent is used in some cases. In a case where such a recording sheet is used, hindrance to the sending of the recording sheet occurs. For example, when a so-called tab sheet on which a tab for putting an index thereon is provided in a projecting state is made to impinge upon the resist rolls with the tab projecting from a front end of the tab sheet, the tab sheet which has theretofore been sent forward accurately starts being sent diagonally due to the projecting tab. Moreover, the time during which the recording sheet is sent forward is delayed by a period of time corresponding to the length of the tab, so that an image cannot be transferred onto an accurate portion of the recording sheet.

In order to deal with such problems, when the forming of an image is done by not disposing the edge, on which the tab is provided, of the tab sheet on the forward side, inconveniences do not occur. However, when images are formed on both surfaces of a tab sheet, the direction in which the tab sheet is sent is reversed. Therefore, in order to transfer an image onto the rear surface of the tab sheet, the tab sheet is sent with the edge thereof on which the tab is provided directed forward, though the tab was positioned at the rear end of the tab sheet during the formation of an image on an outer surface of the tab sheet. When a tab sheet is sent so that the tab is positioned on the lateral side thereof, inconveniences occur in a certain case where after-treatments, such as hole making operations and sheet binding operations are carried out continuously.

Other means for solving the above problems are disclosed in JP-A-2003-226448 and JP-A-2003-122223. In the image forming apparatuses disclosed in these publications, an image is formed in accordance with a predetermined portion of a recording sheet being sent, and the image is transferred onto the mentioned portion of the recording sheet. Therefore, stopping the recording sheet temporarily and regulating the time for feeding the recording sheet again becomes unnecessary. In short, these apparatuses are adapted to form an image in accordance with the time at which a recording sheet is sent out, and transfer the image onto an accurate portion on the surface of the recording sheet. Therefore, even when a tab and the like is provided on a front end of the recording sheet, inconveniences do not occur during the sending of the recording sheet.

SUMMARY OF THE INVENTION

Although the above-described techniques have been proposed, there is still a problem which will be described as follows, and which demands to be solved.

When an image is formed in accordance with the time at which the recording sheet is sent out as disclosed in JP-A-2003-226448 and JP-A-2003-122223, it becomes complicated to control the processing and writing of the image. On the other hand, an apparatus in which a recording sheet is sent to a transfer unit at a predetermined time by using resist rolls is simply controlled, and a mechanism for sending the recording sheet has a simple structure, and can be accurately controlled. Therefore, when a regular rectangular recording sheet is used, it is demanded that a structure for sending the recording sheet to a transfer unit in accordance with an image to be formed.

However, only when a tab-carrying recording sheet is used, the regulating of the position of an image to be formed on the basis of the recording sheet being sent makes it increasingly complicated to carry out the control operation. Therefore, it is difficult to use both a structure for sending out a recording sheet on the basis of an image and a structure for regulating the position of an image to be formed in the same image forming apparatus.

The present invention has been made in view of the above-described circumstances, and the invention provides an image forming apparatus which is adapted to form an image in an accurate position on a recording sheet by regulating the time at which the recording sheet is sent out, and which is capable of forming an image in such a position as mentioned above even when a recording sheet provided with a tab at a front end thereof is used.

According to one aspect of the invention, an image forming apparatus includes: a sheet tray in which recording sheets are held in a stacked state; an image forming unit that forms an image on a recording sheet; a sheet transporting path that allows a transportation of the recording sheet fed one by one from the sheet tray to the image forming unit; and a sheet detecting unit that detects a passage of a rear end, with respect to a direction in which the recording sheet is transported, of the recording sheet that is sent along the sheet transporting path to the image forming unit; wherein the transportation of the recording sheet is temporarily stopped at the time of, or after a predetermined time from when the rear end is detected by the sheet detecting unit; and the transportation of the recording sheet is resumed on the basis of data on a size of the transported recording sheet and a timing of image formation by the image forming unit.

According to another aspect of the invention, an image forming apparatus includes: a sheet tray in which recording sheets are held in a stacked state; an image forming unit that forms an image on a recording sheet; a sheet transporting path that allows a transportation of the recording sheet fed one by one from the sheet tray to the image forming unit; and a sheet detecting unit that detects a passage of a rear end, with respect to a direction in which the recording sheet is transported, of the recording sheet that is sent along the sheet transporting path to the image forming unit; wherein a velocity of the transportation is adjusted on the basis of data on a size of the transported recording sheet and a timing of image formation by the image forming unit, after the rear end of the recording sheet is detected by the sheet detecting unit.

BRIEF DESCRIPTION OF THE DRAWINGS

The present invention may be more readily described with reference to the accompanying drawings.

DETAILED DESCRIPTION OF THE EMBODIMENTS

Below, an embodiment of the invention will now be described with reference to drawings.

Figure 1:
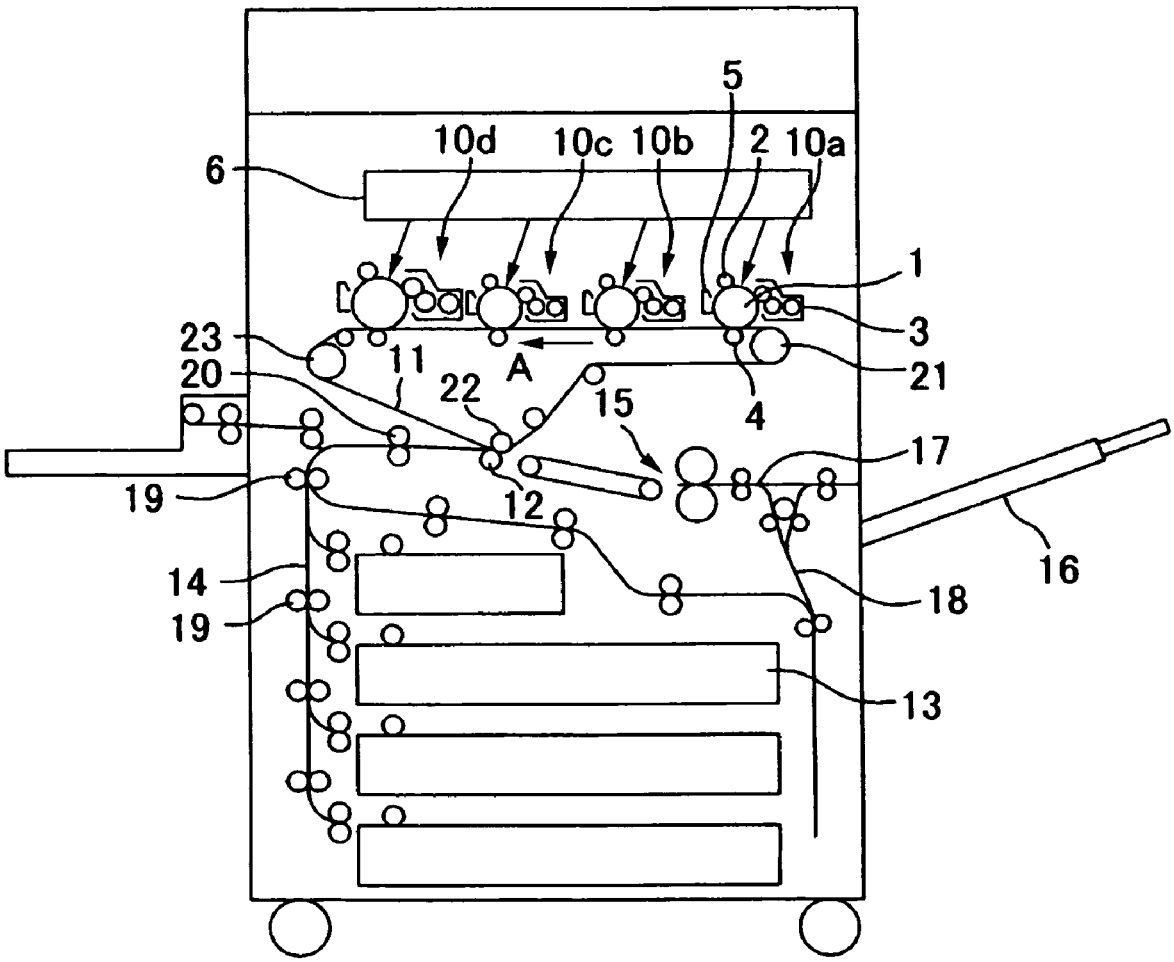
FIG. 1 is a schematic diagram showing a structure of one mode of embodiment of the image forming apparatus.
Figure 2:
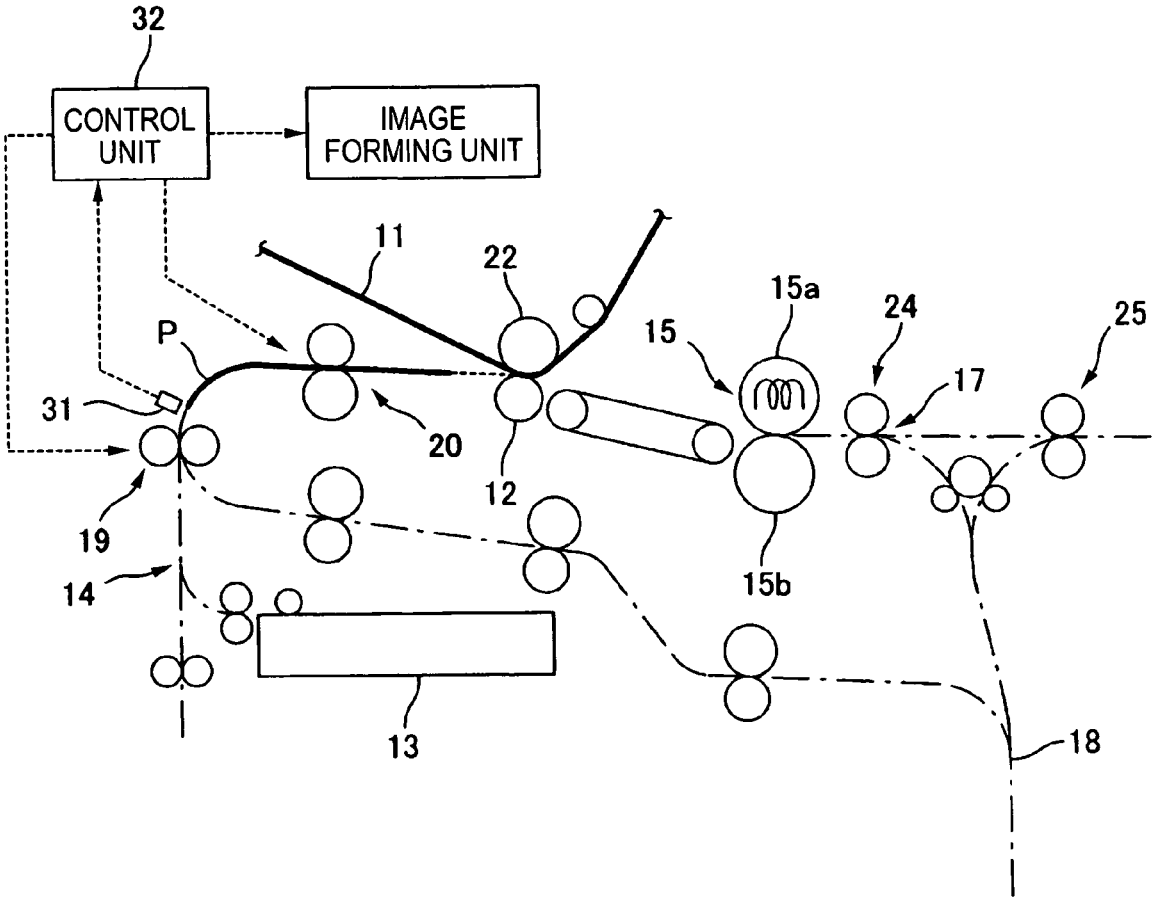
FIG. 2 is a schematic diagram showing a condition of the image forming apparatus shown in FIG. 1 in which the recording sheet is sent with the rear end thereof used as a reference to the secondary transfer unit.

FIG. 1 is a schematic diagram showing a first embodiment of the image forming apparatus. FIG. 2 is a schematic diagram showing a principal portion of the path of sending a recording sheet in the same image forming apparatus.

This image forming apparatus is provided with four image forming units 10*a*, 10*b*, 10*c* and 10*d* for forming yellow, magenta, cyanic and black toner images. An endless belt-like intermediate transfer member 11 is supported so that the transfer member 11 is opposed to the respective image forming units 10, the transfer member being circumferentially driven at a circumferential surface thereof. On the downstream side of the position in which the image forming units are opposed to the intermediate transfer member 11, transfer rolls 12 are provided so that the transfer rolls 12 are opposed to the intermediate transfer member 11, and the recording sheet is sent from a sheet tray 13 to this secondary transfer unit via a sheet sending path 14. On the downstream side of the secondary transfer unit in the recording sheet sending path, a fixing unit 15 is provided which is adapted to heat and pressurize the toner image and fix under pressure the toner image on the recording sheet. On the further downstream side, a paper discharge tray 16 is provided which is adapted to hold the toner image-fixed recording sheet is held. A gate 17 is provided in the portion of a sheet sending path which is between the fixing unit 12 and paper discharge tray 16, and a double surface sending path 18 for reversing outer and rear surfaces of the recording sheet and re-sending the recording sheet to the position in the portion, in which the transfer rolls 12 are provided, of a double surface sending path 18.

In the portion of the sheet sending path 14 which is between the sheet tray 13 and secondary transfer unit, sheet sending rolls 19 are provided. Between these rolls, the recording sheet is held, and the recording sheet is sent when these rolls are rotated. On the upstream side of the secondary transfer unit, resist rolls 20 for sending the recording sheet, and for regulating the time at which the recording sheet is sent to the secondary transfer unit are provided. As shown in FIG. 2, a sheet sensor 31 for detecting a rear end portion of the recording sheet is provided in such a position that is on the upstream side of the secondary transfer unit and away therefrom by a distance longer than a maximum length of the recording sheet in use.

Each of the image forming units 10*a*, 10*b*, 10*c* or 10*d* has a photosensitive drum 1 (image carrier) on an outer surface of which an electrostatic latent image is formed. Around each photosensitive drum 1, a charging unit 2 adapted to charge the outer surface of the photosensitive drum with electricity substantially uniformly, a developing unit 3 for forming a toner image on the photosensitive drum by selectively shifting toner onto the latent image formed thereon, a transfer unit 4 for primarily transferring the toner image on the photosensitive drum 1 onto an intermediate transfer member 11, and a cleaning unit 5 for recovering the toner left on the photosensitive drum 1 after the image transfer operation finishes. An exposure unit 6 for writing an electrostatic latent image on each uniformly charged photosensitive drum by applying thereto image light based on an image signal.

The charging unit 2 is provided with a roll type member formed by coating a cylindrical stainless steel core with rubber of intermediate resistance, and adapted to charge the surface of the photosensitive drum with a desired voltage by applying a voltage in which an AC voltage is superposed on a DC voltage to the charging unit. A DC component Vh of the voltage applied to the charging unit 2 is set to −600 [V], and a peak-to-peak value Vbpp 1400 [V].

The exposure unit 6 is adapted to generate a flashing laser beam on the basis of the image signal, and this flashing laser beam is applied to each photosensitive drum in the primary scanning direction (axial direction) by a polygon mirror to scan the photosensitive drum. As a result, an electrostatic latent image corresponding to the image of each color is formed on the surface of each photosensitive drum 1.

In the developing unit 4, a two-component developer containing a toner and a magnetic carrier is used as a developer, and the developer is magnetically adsorbed to a developing roll opposed to the photosensitive drum 1, and sent forward. The developer is set to a layer of a suitable thickness on the developing roll by a restriction blade, and supplied to a position opposed to the photosensitive drum 1. In order to shift the toner from the developing roll onto the electrostatic latent image on the photosensitive drum 1, a developing bias voltage Vd=−500[V] is applied to the developing roll.

The photosensitive drum 1 is obtained by forming an organic photosensitive layer on a circumferential surface of a cylindrical metal member, and a bias voltage Vl of −200 [V] is applied to the metal portion.

The intermediate transfer member 11 disposed so as to be opposed to the image forming units 10*a*, 10*b*, 10*c*, 10*d* is made of a resin film of a thickness of around 10 to 300 μm, and such a film in use includes a polyimide film and the like. In order that the disorder of the image does not occur when the toner image is electrostatically transferred from the photosensitive drum 1 onto the intermediate transfer member 11, a powdered bodies of a conductive material, such as carbon black are mixed with the above-mentioned resin film, and the volume resistivity is regulated to around $10^{10}$ Ωcm.

On the inner side of the intermediate transfer member 11, a driving roll 21, a counter roll 22 and a support roll 23 are arranged, and the intermediate transfer member 11 is tensely passed around these rolls and circularly moved in the direction of an arrow A shown in the drawing.

The transfer roll 12 is provided in a position in which the transfer roll is opposed to the counter roll 22. The transfer roll 12 is pressed against the counter roll 22 via the intermediate transfer member. This transfer roll 12 is made in the shape of a roll by forming an outer circumferential portion of a conductive metal core out of a rubber material with a transfer bias voltage applied between this roll 12 and the counter roll 22.

The fixing unit 15 includes a heating roll 15*a* containing a heating power source therein, and a pressure roll 15*b* engaged under pressure with the heating roll 15*a*. These rolls constitute a nip unit in which these rolls are arranged in parallel with each other and engaged under pressure with each other. The recording sheet having a toner image transferred thereonto is sent to the nip unit, and heated and pressurized between the rotated heating roll 15*a* and pressure roll 15*b*. The melted toner is deposited under pressure on the recording sheet.

In the portion of the recording sheet sending path which is on the downstream side of the fixing unit 15, a recoding paper sending rolls 24, and paper discharge rolls 25 for sending out the recording sheet into the paper discharge tray 16 are provided. Between the sending rolls 24 and paper discharge rolls 25, a gate 17 is provided which is adapted to switch the recording sheet sending direction from one to the other. This gate 17 is used to switch the recording sheet sending path from one to the other. The gate 17 is adapted to reverse the recording sheet sending direction and send the recording sheet to a double-surface sending path 18 along which the recording sheet is sent again to the transfer unit.

The resist rolls 20 has roll type members on both sides of a path along which the recording sheet passes, and these roll type members are engaged under pressure with each other. The rotation of the resist rolls 20 is controlled by a control unit 32 which is adapted to control the operation of the image forming apparatus as a whole, and the time at which the recording sheet is sent to the secondary transfer unit is regulated by the rotation of the resist rolls 20. The rotation of the recording sheet sending rolls 19 provided on the upstream side of the resist rolls 20 is also controlled by the control unit 32.

The sheet sensor 31 has a light-emitting element and a light-receiving element, and is adapted to detect the light reflected on the recording sheet being sent, or the light interrupted when the recording sheet passes and thereby detect the passage of the rear end of the recording sheet. An output from this sheet sensor 31 is inputted into the control unit 32, and the driving of the resist rolls 20 and recording sheet sending rolls 19 is controlled on the basis of the inputted data.

The operation of the image forming apparatus will now be described.

In the four image forming units 10*a*, 10*b*, 10*c*, 10*d* provided so as to be opposed to the intermediate transfer member 11, and forms yellow, magenta, cyanic and black toner images respectively. The forming of the toner images is done in the following steps.

The photosensitive drums 1 are electrostatically charged substantially uniformly by the charging units 2, and a laser beam turned on and off in accordance with an image signal is applied from the exposure unit 6 to the drums 1. As a result, the electrostatic charge in the positions irradiated with the laser beam is attenuated, and latent images due to differences in the electrostatic potential are formed on the photosensitive drums 1. The electrostatic latent image on each of the photosensitive drum 1 is developed due to the transposition of the toner in an opposed position with respect to the developing unit 3, and a toner image is formed on the photosensitive drum 1.

The toner images of various colors formed are transferred in a superposed manner onto the intermediate transfer member 11 by the transfer unit 4. As a result, a color image in which the toner images of a plurality of colors are laminated on the intermediate transfer member is formed. The toner image of a plurality of colors formed on the intermediate transfer member 11 is sent to the secondary transfer unit, which is opposed to the transfer roll 12, owing to the circumferential movement of the intermediate transfer member 11.

Figure 4:
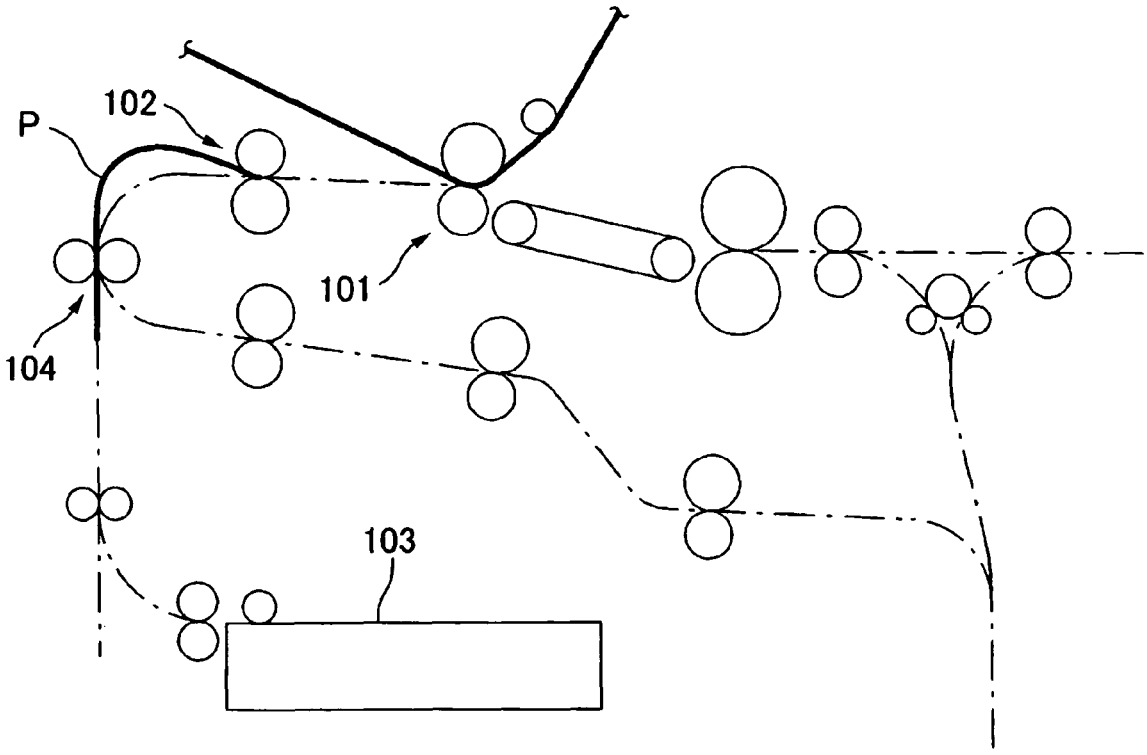
FIG. 4 is a schematic diagram showing a condition of a related art image forming apparatus with the recording sheet sent to the secondary transfer unit.

On the other hand, a recording sheet is drawn out from the sheet tray 13, and sent along the sheet sending path toward the transfer unit. When at this time, a general cut paper, i.e. a rectangular recording sheet a front end of which extends at right angles to the sheet sending direction is used as a recording sheet onto which the toner image is transferred, a front end base mode is selected. The recording sheet sent along the recording sheet sending path 14 is stopped by making the recording sheet impinge upon the pressure contacting portions of two rolls of the resist rolls 20 in suspension. During this time, the upstream side sheet sending rolls 19 are controlled so that, after the front end of the recording sheet is made to impinge upon the resist rolls 20, the upstream side sheet sending rolls 19 feed out the recording sheet by a predetermined length. The recording sheet is stopped bent between the sheet sending rolls 19 and resist rolls 20 in the same condition as shown in FIG. 4. Owing to this arrangement, even when the front end of the recording sheet is pressed against the resist rolls 20 due to an elastic resiliency of the recording sheet, so that the recording sheet is sent diagonally, this inconvenience is eliminated.

The driving of the resist rolls 20 is then resumed in accordance with the time at which the toner image on the intermediate transfer member 11 is sent thereto, and the recording sheet is sent to the secondary transfer unit, onto which the toner image is electrostatically transferred. The recording sheet onto which the toner image has been transferred is sent to the fixing unit 15, in which the recording sheet is held between the heating roll 15*a* and pressure roll 15*b*. The heating roll 15*a* is heated to a temperature high enough to melt the toner image. The toner image is melted between the heating roll 15*a* and pressure roll 15*b*, and compressed on the recording sheet. The recording sheet sent out from the fixing unit 15 is sent by the sheet sending rolls 24 and paper discharge rolls 25, and discharged to the paper discharge tray 16.

The operation of the apparatus in a case where an image is formed on both surfaces of a recording sheet in use made of a tab-carrying recording sheet will now be described.

The recording sheet is now held in the sheet tray 13 so that a tab-carrying end thereof forms a rear end. The recording sheet drawn out from the sheet tray 13 is sent with the tab-carrying end set as a rear end thereof. In order to transfer the toner image onto the outer surface of the recording sheet, front end based mode is selected, and the time at which the recording sheet is sent to the secondary transfer unit by the resist rolls 20 is controlled in the same manner as in the case where a previously described regular recording sheet is used. The selecting of the front end base mode is done by the control unit in accordance with the kind of the recording sheet to be used and an image forming pattern as in the double surface printing operation which are designated by the operator.

The recording sheet onto the outer surface of which a toner image is transferred in the secondary transfer unit is sent to the double surface sheet sending path 18 via the fixing unit 15. In the double surface sheet sending path 18, the sheet sending direction is reversed, and the recording sheet is sent again to the secondary transfer unit. Since the sheet sending direction is reversed during this time, the tab-carrying end constitutes a front end of the recording sheet. Concerning the controlling of the time at which the recording sheet is sent, a rear end based mode is selected.

When the rear end of a recording sheet P is detected by the sheet sensor 31 in the sheet sending path, a signal is inputted into the control unit, and the sending of the recording sheet is stopped so that the front end reaches a predetermined position in front of the secondary transfer unit. In short, the time at which the sheet sending rolls 19 and resist rolls 20 are stopped is controlled so that the front end of the recording sheet reaches a predetermined position on the basis of the length of the recording sheet in the sheet sending direction. At this time, the front end of the recording sheet reaches a position on the downstream side of the resist rolls 20. In the rear end based mode, the resist rolls 20 are not stopped at the time of arrival of the recording sheet at these rolls but driven at the same peripheral speed as the sheet sending rolls.

When the toner image on the intermediate transfer member 11 is sent, the sending of the recording sheet by the resist rolls 20 and sheet sending rolls 19 is resumed, and the recording sheet is sent to the secondary transfer unit. When the recording sheet sending operation is resumed, the front end thereof temporarily stopped is in a predetermined position on the downstream side of the resist rolls 20. Therefore, the resumption of the sending of the recording sheet may be controlled so that this sheet sending operation is delayed by the time corresponding to the length by which the recording sheet projects from the resist rolls 20 in the downstream direction as compared with a case where the front end of the recording sheet runs into the resist rolls 20.

The recording sheet onto the rear surface of which the toner image has been transferred is sent to the fixing unit 15, and the toner image on the rear surface of the recording sheet is fixed, the resultant recording sheet being discharged to the paper discharge tray 16.

The image forming apparatus, another embodiment of the invention will now be described below.

This image forming apparatus is adapted in the same manner as the apparatus shown in FIG. 1 to transfer a toner image on the recording sheet that is sent to the secondary transfer unit in a front end based mode or in a rear end based mode. However, the controlling of the sending of the recording sheet in the rear end based mode is different from that of the corresponding operation in the front end based mode. The structure of the other parts is similar to that of the corresponding parts of the image forming apparatus shown in FIG. 1.

Figure 3:
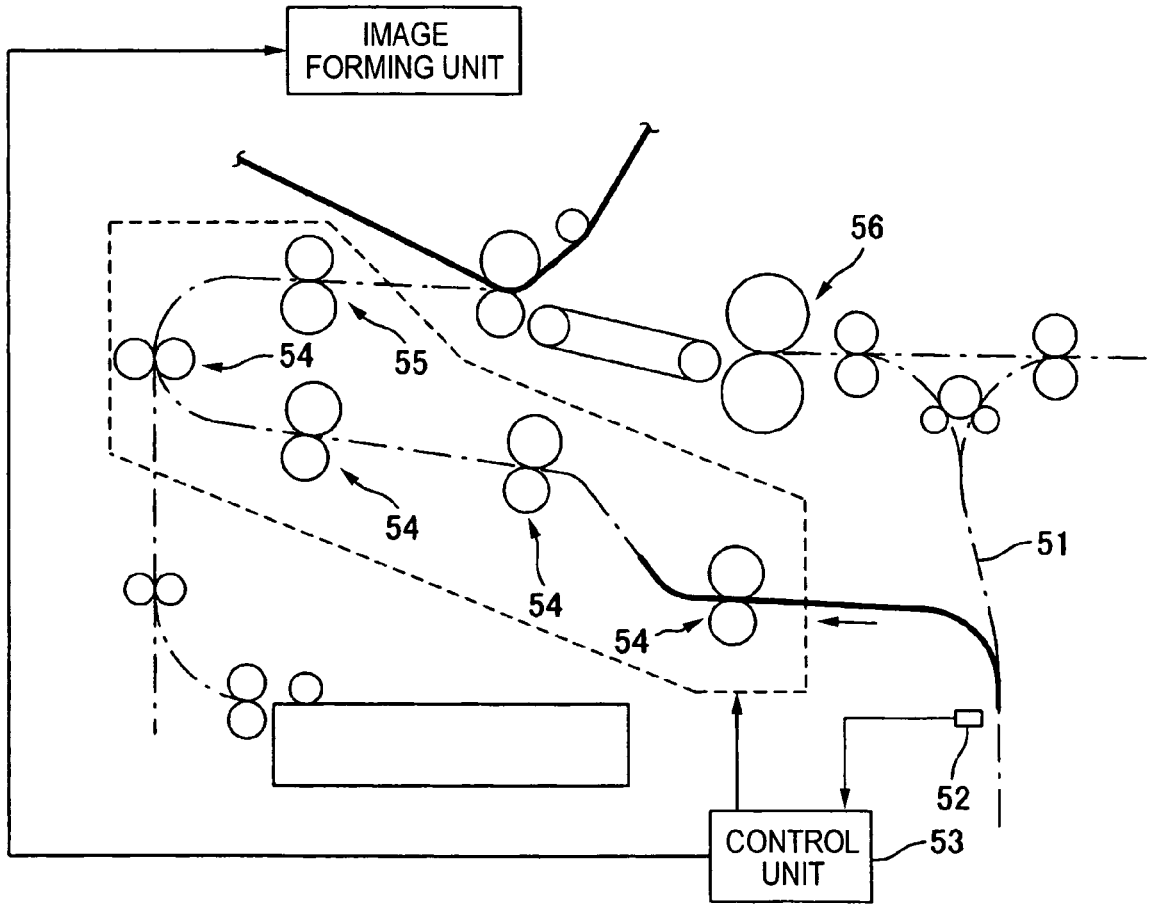
FIG. 3 is a schematic diagram showing a condition of another mode of embodiment the image forming apparatus in which the recording sheet is sent to the secondary transfer unit with the rear end thereof used as a reference to the secondary transfer unit.

In order to form a toner image on both surfaces of a tab-carrying recording sheet in the image forming apparatus of this embodiment, the recording sheet is sent to a double surface sending path 51 after a toner image has been transferred onto the outer surface thereof and fixed thereto. As shown in FIG. 3, a sheet sensor 53 is provided in a position in which the sheet sending direction has already finished being reversed in the double surface sending path 51. The rear end of the recording sheet is detected by this sheet sensor 53, and after this instance, a period of time during which an image to be subsequently formed reaches the secondary transfer unit is computed. The speed at which the recording sheet is sent is computed on the basis of the distance between the position in which the rear end of the recording sheet is detected and that in which the secondary transfer unit is provided. The recording sheet sending distance is determined by subtracting the length of the recording sheet in the sheet sending direction from that of the sheet sending path between the position of the sheet sensor 53 and that of the secondary transfer unit. The recording sheet sending speed is set so that the time during which the recording sheet is sent becomes suitable for transferring the toner image being sent on the intermediate transfer member.

The sheet sending rolls 54 and resist rolls 55 are rotated with the peripheral speeds thereof controlled, so as to send the recording sheet at this speed. The recording sheet is sent by these rolls, and sent as it is without being stopped to the secondary transfer unit. The recording sheet is then subjected to a toner image fixing operation via the fixing unit 56, and discharged to the sheet discharge tray.

Even in the image forming apparatus thus controlled, a recording sheet having a tab at the front end thereof can be sent to the secondary transfer unit at a predetermined time, and a toner image can be formed in an accurate position.

In the embodiment described above, a rear end based mode is selected when the recording sheet is sent from the double surface transfer path. The rear end based mode may be selected when the recording sheet is sent from the sheet tray. In short, when the recording sheet having a tab at the front end thereof is sent from the sheet tray to form an image thereon, the time at which the recording sheet is sent to the secondary transfer sheet is sent to the secondary transfer unit.

In the image forming apparatus according to the embodiments as described above, the rear end of the recording sheet is detected by the sheet detecting unit, and the sending of the recording sheet is temporarily stopped on the basis of the detected data. During this time, the position of the front end of the recording sheet is accurately determined with reference to the detected size data. The driving of the recording sheet is resumed in accordance with the time at which the image is formed, in such a manner that the front end of the recording sheet is sent to the image forming unit. Therefore, the time at which the front end of even a recording sheet provided with a tab at the front end thereof and even a recording sheet the front end of which is not at right angles accurately to the sheet sending direction are sent to the image forming unit can be controlled accurately, and an image is formed in accurate positions of these recording sheets.

The sending of the recording sheet may also be temporarily stopped when a predetermined period of time elapses after the rear end of the recording sheet is detected, besides the case where the sending of the recording sheet is temporarily stopped immediately when the rear end of the recording sheet is detected by the sheet detecting unit. For example, when the time at which the sending of a recording sheet is temporarily stopped correspondingly to the size thereof is controlled, the recording sheet can be stopped with the front end thereof set in the same position even when the size of the recording sheet is different. When the sending of the recording sheet is controlled in this manner, the time at which the sending of the recording sheet is resumed can be set constant with respect to the image forming process.

This image forming apparatus is also provided on the upstream side of the image forming unit in the sheet sending path with resist rolls provided with two rolls driven in a mutually pressure-contacting state. When a general rectangular recording sheet, i.e., a recording sheet the front end of which is at right angles to the recording sheet sending direction is used, the front end of the recording sheet being sent is made to impinge upon the resist rolls and the sending of the recording sheet is temporarily stopped. The sending of the recording sheet can thereafter be controlled so that the recording sheet is sent to the image forming unit at a predetermined time. In short, when a general rectangular recording sheet is used, the sending thereof is controlled as a front end based mode using resist rolls. When a recording sheet having a tab and the like at a front end thereof is used, a rear end based mode is employed in which the rear end of the recording sheet is detected in the sheet detecting unit, and in which the sending of the recording sheet is thereby controlled. A switching means for shifting these modes from one to the other shall be provided.

Owing to this arrangement, when a rectangular recording sheet is used, a diagonal movement thereof is corrected by using resist rolls, and the recording sheet is sent to the image forming unit at an accurate time. A recording sheet having a tab and the like at the front end thereof can be sent to the image forming unit at an accurate time on the basis of the position of the rear end thereof.

The switching unit may be a switching unit formed so that the operator selects a mode directly by using a control panel, and a switching means adapted to shift a mode from one to the other when a sensor detects the tab and the like.

In the above-described image forming apparatus, the sending of the recording sheet is temporarily stopped after the sheet detecting unit recognizes the rear end of the recording sheet. Instead of this apparatus, an apparatus in which the recording sheet sending speed is regulated after the rear end of the recording sheet is detected may also be used. In short, the position of the front end is determined with reference to the sizes of the recording sheet being sent, and the sending speed of the recording sheet in the sending path is regulated so that the front end reaches the image forming unit at a predetermined time.

Even in such a structure, the recording sheet can be sent to the image forming unit at a predetermined time on the basis of the rear end thereof, and an image can be formed in an accurate position. Moreover, the mode thus controlled, and the mode, which has heretofore been generally used, in which the time at which the recording sheet sending operation is carried out is regulated on the basis of the front end of the recording sheet by using resist rolls can be used by shifting one of these modes to the other.

In the image forming apparatus according to the present invention described above, the rear end of the recording sheet is detected by the sheet detecting unit, and the recording sheet is sent to the image forming unit in accordance with the time at which the image is formed on the basis of the detected data. Therefore, the time at which the front end of the recording sheet is sent to the image forming unit can be accurately controlled even when the recording sheet provided with a tab at the front end thereof, and a recording sheet the front end of which is not at accurately right angles to the direction in which the recording sheet is sent are used. The image is formed in an accurate position on the recording sheet.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a sheet tray in which recording sheets are held in a stacked state;

an image forming unit that forms an image on a recording sheet;

a sheet transporting path that allows a transportation of the recording sheet fed one by one from the sheet tray to the image forming unit;

a sheet detecting unit that detects a passage of a rear end, with respect to a direction in which the recording sheet is transported, of the recording sheet that is sent along the sheet transporting path to the image forming unit, wherein a velocity of the transportation is adjusted on the basis of data on a size of the transported recording sheet and a timing of image formation by the image forming unit, after the rear end of the recording sheet is detected by the sheet detecting unit;

a resist roll disposed upstream of the image forming unit on the sheet transporting path, the resist roll including a pair of rolls that are rotated while being in pressure-contact with each other; and a switch unit that switches a front end reference mode and a rear end reference mode, the front end reference mode for sending the recording sheet to the image forming unit at a predetermined timing that is after a temporal stop of the transportation caused by an interference of a front end of the recording sheet onto the resist roll, the rear end reference mode for adjusting the velocity of the transportation after the rear end is detected by the sheet detecting unit.

* * * * *